US005507345A

United States Patent [19]

Wehunt, Jr. et al.

[11] Patent Number: 5,507,345

[45] Date of Patent: Apr. 16, 1996

[54] METHODS FOR SUB-SURFACE FLUID SHUT-OFF

[75] Inventors: Clyde D. Wehunt, Jr., Kingwood, Tex.; Bradley G. Gautreaux, Baton Rouge, La.; Jeffrey P. Ortwein, Concord, Calif.

[73] Assignee: Chevron U.S.A. Inc.

[21] Appl. No.: 344,420

[22] Filed: Nov. 23, 1994

[51] Int. Cl.[6] ..... E21B 33/10

[52] U.S. Cl. ..... 166/285; 166/292

[58] Field of Search ..... 166/278, 285, 166/292

[56] References Cited

U.S. PATENT DOCUMENTS

| | | | |
|---|---|---|---|
| 3,182,723 | 5/1965 | Layne, Sr. | 166/51 |
| 3,314,479 | 4/1967 | McCullough et al. | 166/63 |
| 3,818,986 | 6/1974 | Abney et al. | 166/51 |
| 3,866,682 | 2/1975 | Jones et al. | 166/285 |
| 4,187,909 | 2/1980 | Erbstoesser | 166/285 X |
| 4,194,561 | 3/1980 | Stokley et al. | 166/162 |
| 4,444,264 | 4/1984 | Dill | 166/294 |
| 4,972,906 | 11/1990 | McDaniel | 166/276 |
| 5,090,478 | 2/1992 | Summers | 166/278 |
| 5,222,558 | 6/1993 | Montgomery et al. | 166/278 |
| 5,228,524 | 7/1993 | Johnson et al. | 175/72 |

FOREIGN PATENT DOCUMENTS 1217320 2/1987 Canada .

OTHER PUBLICATIONS

L. E. Mendez et al., "*Field Use of Thru–Tubing Electric Wireline Set Bridge Plug System,*" Offshore Technology Conference 6459, 1990.

*Primary Examiner*—William P. Neuder
*Attorney, Agent, or Firm*—Burns, Doane, Swecker & Mathis

[57] ABSTRACT

Methods for reducing or eliminating undesirable fluid-production in a producing well by releasing a plugging material below an obstruction placed in the producing zone. The obstruction is placed near the base of a desirable fluid-producing interval. The plugging material flows outward to form a barrier to the flow of undesirable fluids into the desirable fluid-producing interval. For most applications, a buoyant plugging material is used so that undesirable fluid crossflow carries the plugging material to the location where it is needed to form a barrier to the undesirable fluid production. The present invention can be used in gravel-packed wells, open hole wells, slotted-liner wells, monobore completion wells, or cased-hole wells. The present invention can also be used with a pair of obstructions with a plugging material released between them to shut off multiple intermediate intervals producing undesirable fluids. In some circumstances, the present invention can be used with a pair of obstructions without the need for a plugging material to be released between the obstructions. Likewise, the invention can be used in vertical, inclined, or horizontal wells.

51 Claims, 5 Drawing Sheets

METHODS FOR SUB-SURFACE FLUID SHUT-OFF

BACKGROUND OF THE INVENTION

This invention relates to the production of a desirable fluid (e.g., oil, gas, water, etc.) from a subterranean formation, and more particularly to a method for reducing undesirable fluid production from a producing well penetrating the formation or another formation or formations penetrated by the producing well.

In one application, the desirable fluid is water that is useful for personal, municipal, or commercial use, and the undesirable fluid is water not valuable for the same use. An example of this application is a well penetrating one formation containing potable water and another formation containing brackish water.

In another application, the desirable fluid is water that contains a commercially valuable concentration of one or more chemical species, and the undesirable fluid is water without the commercially-valuable concentration. An example of this application is a well penetrating one formation that contains water with a commercially-valuable bromide ion concentration and another formation containing water without a sufficient bromide ion concentration.

In still another application, the desirable fluid contains a commercially-valuable gas concentration, and the undesirable fluid does not. An example of this application is a well penetrating one formation that contains a commercially-valuable concentration of carbon dioxide and another formation containing fluid without sufficient carbon dioxide.

In yet another application, the desirable fluid contains a commercially-valuable hydrocarbon concentration and the undesirable fluid is water without a hydrocarbon concentration sufficient for commercial use. An example of this application is a well penetrating one formation containing a fluid with a commercially-valuable concentration of oil and a portion of the formation or another formation penetrated by the well containing water without a commercially-valuable concentration of oil. As will be appreciated by one of ordinary skill in the art, the hydrocarbon can be oil, gas, or any mixture thereof.

As will be appreciated by one of ordinary skill in the art, the desirable fluid can contain any desirable product extracted from subterranean formations through wells, or a mixture of any of these desirable products. As will also be appreciated by one of ordinary skill in the art, different portions of a single subterranean formation can contain one or more desirable fluids and one or more undesirable fluids. As will also be appreciated by one of ordinary skill in the art, desirable fluids can occur in multiple subterranean formations intersected by a well, and undesirable fluids can occur in many other subterranean formations intersected by the well that lie between the subterranean formations containing the desirable fluids.

In a water-drive reservoir, the predominant mechanism which forces the movement of desirable fluid in the reservoir toward the wellbore is the advancement of a formation water aquifer. The formation water phase is found beneath the hydrocarbon phase in a bottom-water, hydrocarbon-beating reservoir or on the outer flanks of the hydrocarbon column in an edge-water, hydrocarbon-bearing reservoir. In a water-flooded reservoir, water is injected into the formation in water injection wells, forcing the movement of desirable fluids toward the producing well. In these cases, water moves into the reservoir pore spaces which were once filled with desirable fluids in response to continued production of the desirable fluids. Over time, this water movement leads to the advancement of water into the producing zone of the wellbore and the well eventually begins to produce undesirable quantities of water. The ever increasing production rate of water is undesirable in hydrocarbon-producing wells and eventually makes the wells uneconomical to operate. There has been a continuing need for an economical and effective method for reducing or virtually eliminating the water production from such wells.

In a gas-cap-expansion reservoir the predominant mechanisms which force the movement of desirable fluid toward the wellbore are the expansion of an overlying gas cap and the effect of gravity. In a hydrocarbon-bearing reservoir, oil and dissolved gas are found beneath the gas cap. In a gas-flooded reservoir, gas is injected into the formation in gas injection wells, forcing the movement of desirable fluids toward the producing well. In these cases, gas moves into the reservoir pore spaces which were once filled with desirable fluids in response to continued production of the desirable fluids. Over time, this gas movement leads to the advancement of undissolved gas into the producing zone of the wellbore and the well eventually begins to produce undesirable quantities of undissolved gas. This is undesirable because it reduces the desirable fluid production capacity of the well and inefficiently uses the energy of the expanding gas cap or the injected gas to move the desirable fluid toward the well. There is a need for a method to reduce or eliminate the undissolved gas production from such wells.

In combination-drive reservoirs, the effects of water-drive and gas-cap-expansion can both occur. In this type reservoir, an edge-water or bottom-water-drive combines with the effect of an expanding gas cap to force desirable fluid toward the production well. There is a need for an economical and effective method to shut off undesirable, undissolved gas production and water production in these type reservoirs.

Separate reservoirs are often found vertically stacked in adjacent formations, often referred to as layers (i.e., multi-layered reservoirs). To extract the desirable fluids from these multi-layered reservoirs in the most economical manner, single boreholes are often used to simultaneously extract fluids from multiple reservoirs. The region where the borehole intersects one of these reservoirs is referred to as a production zone. A single zone can have more than one fluid-producing region, referred to as intervals. The reservoirs usually have unique fluid properties, geologic properties, and production drive mechanisms. In these reservoirs, it is sometimes necessary to shut off undesirable fluid production in a location in the borehole that is intermediate between two desirable fluid-productive intervals, with the two desirable fluid-productive intervals usually in different zones.

In producing wells, there is the common occurrence of unconsolidated sandstone reservoir rock formations. In this type of formation, sand grains which make up the sandstone rock do not contain adequate inter-granular cementation or rock strength to ensure rock stability during the production of fluids. As a result, the rock in its natural state often fails when subjected to the stresses imposed on it during fluid production. Small rock fragments are then produced into the wellbore. Once accumulated in the wellbore, the low permeability of this fine grain material restricts the productivity of the adjacent formation and deeper portions of the formation.

Various techniques to increase the stability of the sandstone reservoir rock (i.e., methods of sand control) have been employed. One such method is commonly referred to as "gravel packing." In a typical gravel-packed well, one or more perforated joints of production tubing are wrapped with screen. The wrapped section of production tubing is located adjacent a producing zone. Uniformly sized and shaped sand grains (i.e., "gravel") are placed (i.e., "packed") in a wellbore's perforations and in the annular volume between the well's production casing and the screen surrounding the production tubing. The sand grains, or "gravel", are packed tightly together and sized as large as possible while still restricting the formation sand from moving into the gravel. The openings in the screen around the production tubing are sized as large as possible while still restricting the gravel from passing through the openings. In this way, productivity is kept as high as possible while preventing formation sand and gravel from entering the tubing. The screen is normally placed between two packers which contains the sand in an area adjacent to the producing zone. As the well is produced, undesirable fluid moves into the producing zone and remedial measures which isolate the undesirable fluid from the production tubing are necessary.

One known method of isolating an undesirable fluid-producing interval within the production zone is to dump cement into the wellbore. There are several problems with the use of cement for this purpose. First, when cement is dump bailed into the wellbore, a malfunction of the bailer can inadvertently bridge off cement in the unperforated (i.e., blank) area of the tubing above the gravel-packed region. The cement must then be drilled out to clear the tubing. Second, if the cement formulation is not correct, the cement may not completely penetrate the perforated tubing and may fail to block off channels between the tubing and the gravel-pack screen. Third, even if the cement effectively blocks the channels between the tubing and the screen, undesirable fluid still flows vertically through the gravel-packed annulus. Another known method of isolating an undesirable fluid-producing interval within the production zone is to convey an obstruction near the base of the desirable fluid-producing interval using regular tubing or a coiled tubing, and then pump a plugging material below the obstruction using regular tubing or coiled tubing as a conduit for the plugging material. It is not known to release a plugging material below an obstruction without using regular tubing or coiled tubing. Also, it is not known to pump a buoyant plugging material.

Another known procedure is disclosed in U.S. Pat. No. 4,972,906 issued to McDaniel. This procedure involves delivering a mixture of a liquid epoxy material and a hardener for the epoxy material to a gravel-packed region to seal off the production of water. The mixture of liquid epoxy material and hardener is characterized in that the epoxy material has a density greater than the density of the well fluids. The first step of the process is to ensure that the well remains essentially dormant (i.e., there is no downhole fluid movement or "crossflow") during the process so that the epoxy is not dispersed into portions of the well which do not require plugging. Also, the epoxy plug can become "honeycombed" if formation fluid continues to trickle into the wellbore before the epoxy is completely hardened. The epoxy material and hardener is dumped in the production tubing in an amount sufficient to form a solid plug from the bottom of the production tubing up to a point slightly above the water interval. In a gravel-packed well, the plug fills the perforated tubing, the screen, and the gravel, and may enter the perforations in the water-producing interval to plug off production of water from the zone. This procedure can be effective but presents problems when the interval to be isolated is long or when there is open casing below the gravel-pack. In either case, a large amount of epoxy is required.

U.S. Pat. No. 5,090,478 issued to Summers discloses a method for reducing water production from a gravel-packed well. The water encroachment interval of a gravel-packed, hydrocarbon-producing well is isolated by placing a plug in the perforated tubing below the hydrocarbon-producing interval, then placing two sand layers on the plug in the perforated tubing. The first sand layer is made up of sand which is coarser than the sand in the gravel pack. This coarse sand bridges off in the channels between the perforated tubing and the gravel-pack screen. The second sand layer is made up of sand which generates a tight matrix in the perforated tubing. A liquid resin is placed on top of the second sand layer. The resin preferentially flows outward into the gravel pack. However, the resin does not form an actual flat disk because some of the resin moves downward somewhat through the gravel, as well as down the channels between the screen and the perforated tubing. The resulting disk-like layer of resin prevents further production of water from the encroaching water interval. One limitation of this method is that water can flow out of the perforated tubing and up through the gravel and/or the formation and back into the perforated tubing (i.e., "crossflow") above the resin plug before the plug has hardened and leave open flow channels through the resin.

In view of the limitations of the known devices, it is an object of the present invention to provide methods for reducing or eliminating undesirable fluid production from a producing well. It is a further object of this invention to provide methods for reducing or eliminating undesirable fluid production that are effective in a wellbore that experiences "crossflow". It is also an object of this invention to provide methods for reducing or eliminating undesirable fluid production that are cost-effective, reliable, and easily reversible.

SUMMARY OF THE INVENTION

Briefly, the present invention comprises methods for reducing or eliminating undesirable fluid production in a producing well. In one embodiment, the invention utilizes releasing a plugging material below an obstruction placed in the producing zone. An obstruction is placed near the base of a desirable fluid-producing interval. The plugging material is released below the obstruction. The plugging material flows outward to form a barrier to the flow of undesirable fluid around the obstruction in the production zone. For most applications, a buoyant plugging material is used so that the undesirable crossflow carries the plugging material to the location where it is needed to form a barrier to undesirable fluid production. Using a particulate plugging material is preferred because it does not require tailoring the initiation of a chemical reaction and therefore is more reliable; however, a resin system or other chemically reactive system could also be used. The present invention can be used in gravel-packed wells, open hole wells, slotted-liner wells, monobore completion wells, or cased-hole wells. The present invention can also be used with multiple obstructions with a plugging material released between them to shut off multiple intermediate undesirable fluid-producing intervals. Likewise, the invention can be used in vertical, inclined, or horizontal wells.

In another embodiment, the invention utilizes a buoyant plugging material pumped below an obstruction using regular tubing or coiled tubing. In still another embodiment, the invention utilizes a pair of obstructions which are in fluid communication to form a barrier to the production of undesirable fluid from an intermediate interval or zone.

BRIEF DESCRIPTION OF THE DRAWING

The invention will now be described with reference to the accompanying drawing, in which.

DETAILED DESCRIPTION OF THE INVENTION

In performing the methods of the present invention, a plugging material is released below an obstruction or between a pair of obstructions in a producing zone in a well to form a barrier to the encroachment of undesirable fluid into a desirable fluid-producing interval. The methods are applicable to both injection type and production type wells. The present methods will be described primarily with reference to oil and gas production wells with cased-hole, gravel packs where water encroachment has led to the advancement of water into the producing zone so that the well produces excessive quantities of water over a period of time. However, the present methods are also applicable to wells with or without gravel packs, and wells equipped with open holes, cased-holes, monobore completions, or slotted-liners. By plugging off the water-producing interval, the flow of water is reduced or even eliminated thus restoring the desired production of hydrocarbons from the well.

Figure 1:
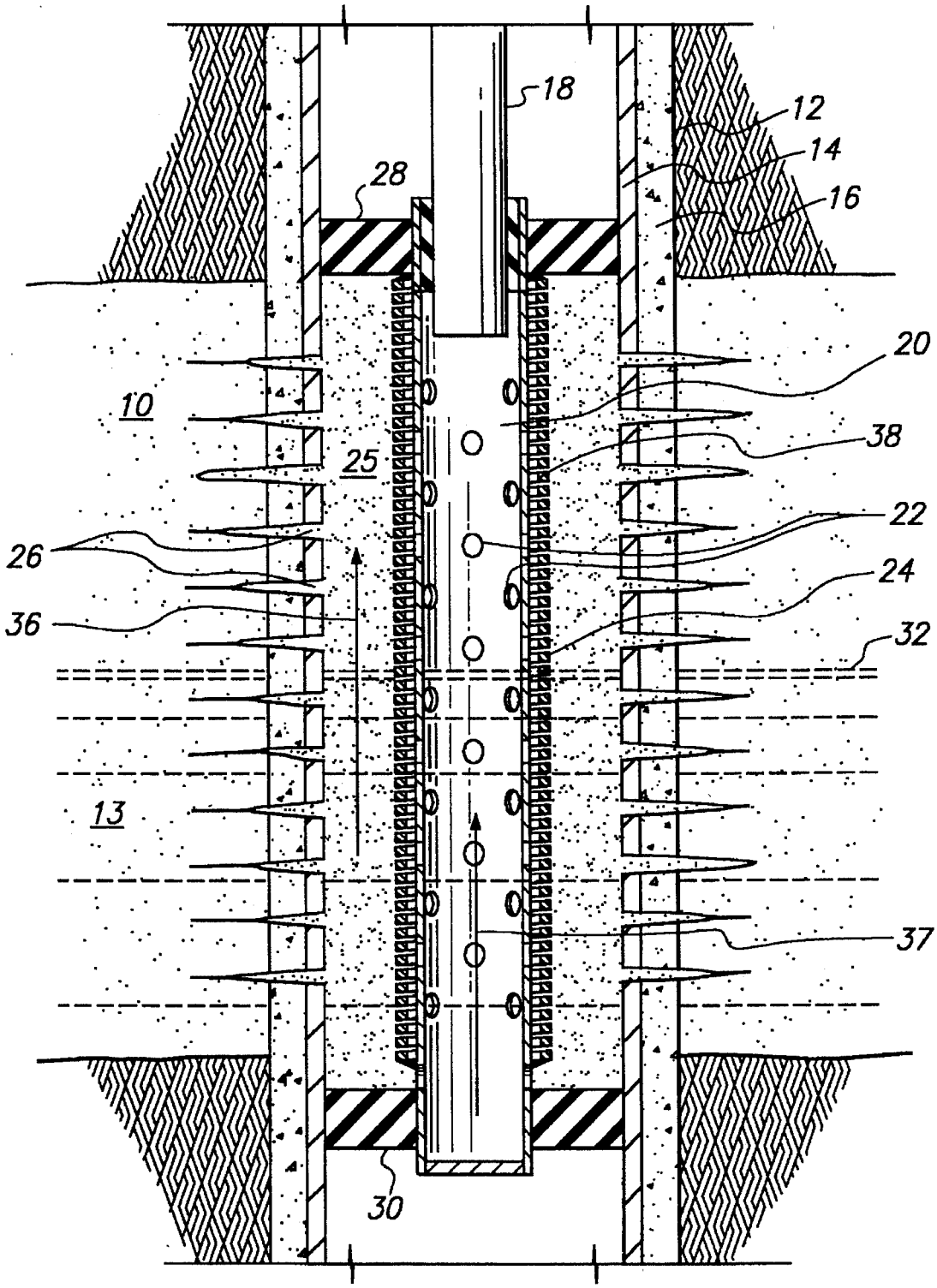
FIG. 1 is a cross-section of a gravel pack completion in a producing formation in which water has encroached into a substantial portion of the gravel-packed region.

The methods of plugging off a water-producing interval will be described with reference to the drawings. Referring to FIG. 1, there is shown a gravel-packed well. In the gravel-packed well is a subterranean desirable fluid-producing (i.e., oil, gas, etc.) interval 10 and water-producing interval 13. Although the desirable fluid-producing interval and the water-producing interval are shown as separate intervals, within a zone, they are not distinct and separate from each other but instead tend to merge together. Likewise, there may be more than just one of each of these zones in a well. Traversing the desirable fluid-producing interval and the water-producing interval is a production zone having casing 14 fixed in place by cement 16 in the annulus between casing 14 and wellbore 12. The portion of the well adjacent to intervals 10 and 13 is separated from the remainder of the well by upper packer 28, which is placed between casing 14 and production tubing 18, and lower packer 30, which is placed between casing 14 and perforated tubing 20 (i.e, the base pipe). Perforated tubing 20 has openings 22 (i.e., perforations) therein. Around the outside of the perforated tubing 20 is a wire-wrapped screen 24, which is usually supported and spaced from the perforated tubing by vertical ribs (not shown). The isolated portion of the well between upper packer 28 and lower packer 30 which surrounds perforated tubing 20 and screen 24 is filled with gravel (i.e., sand) 25. This gravel fills not only the casing but also the perforations 26 extending from the casing 14 through the cement 16 around the casing and into intervals 10 and 13. Gravel-packing is a method used to provide maximum fluid flow from the formation into the perforated tubing 20 without allowing formation sand (i.e., relatively fine sand) from intervals 10 and 13 or gravel 25 to enter the perforated tubing. Therefore, the gravel (i.e., relatively coarser sand) is chosen as large as possible to allow maximum fluid flow without allowing the passage of the formation sand. Similarly, the openings between the coils of screen 24 are spaced as large as possible to allow maximum fluid flow without allowing the passage of the gravel 25.

Figure 3:
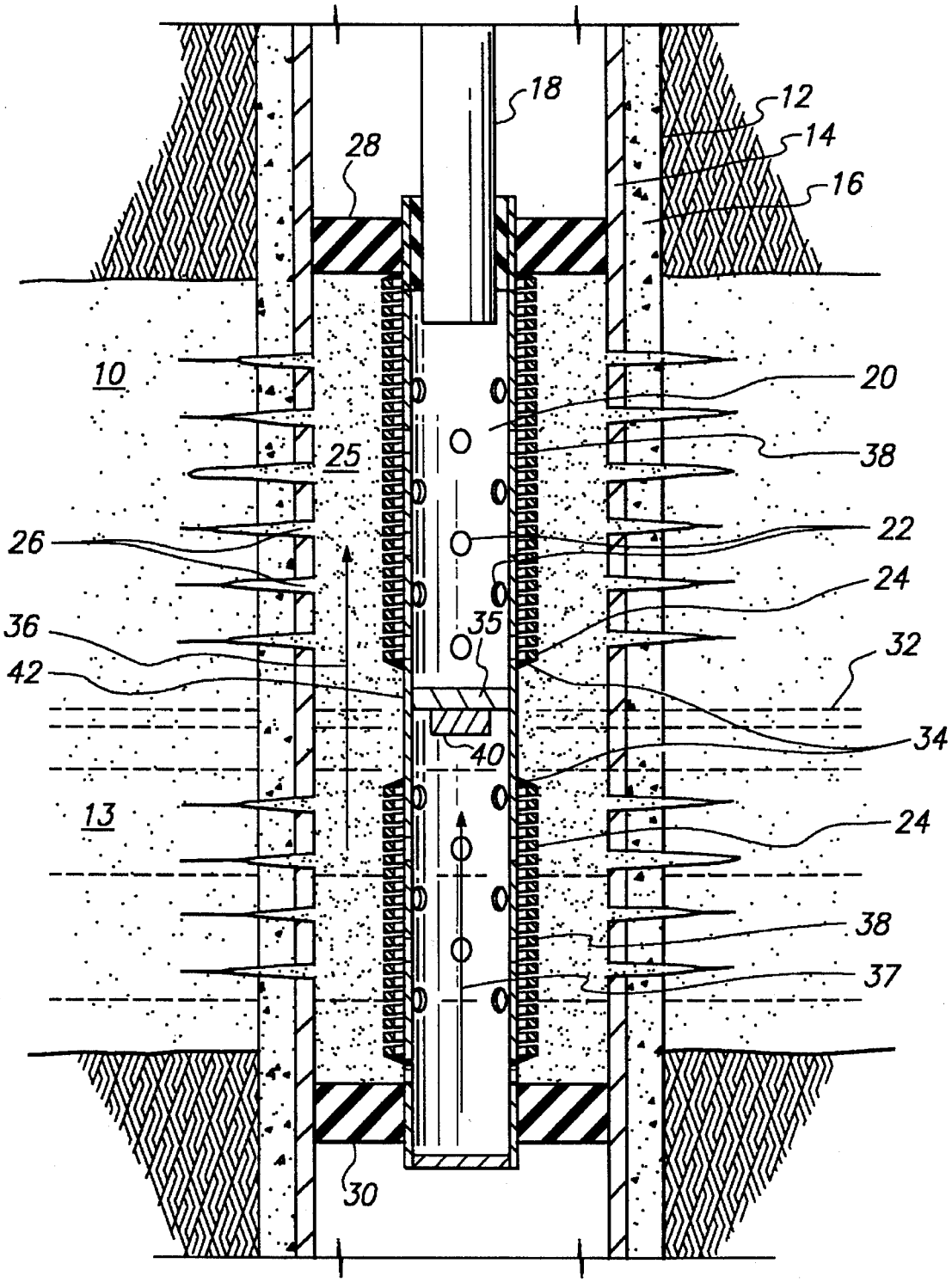
FIG. 3 is a cross-section of a gravel pack completion in a producing formation in which a plug is positioned between two joints of screen.
Figure 4:
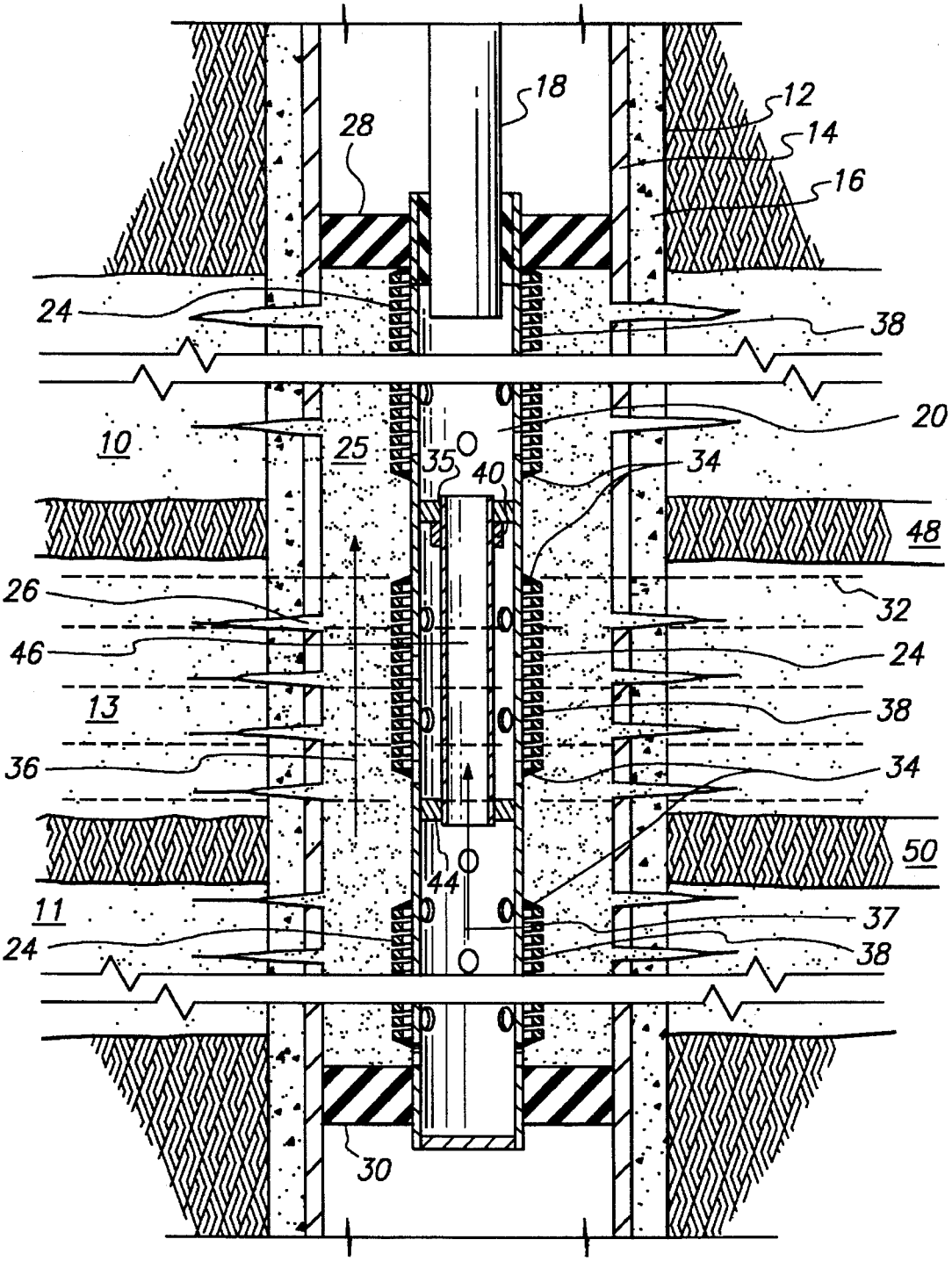
FIG. 4 is a cross-section of a gravel pack completion in three producing zones in which two plugs have been positioned to form a barrier to the encroachment of water or undissolved gas from the middle zone into the top and bottom producing zones.

As shown in FIG. 1, both water and oil are produced simultaneously. The lower portion of the formation contains encroaching water up to level 32, and the upper portion is relatively free of water. The normal flow path for the produced fluids (e.g., oil, gas, water, etc.) is as follows. First, radially inward through the formation until entering casing 14. Then radially inward through gravel 25 continuing radially inward through spiral-wrapped screen 24 into perforated tubing 20. Then linearly through the inside of the perforated tubing 20 into production tubing 18 and linearly through the inside of production tubing 18 until reaching the surface. FIG. 1 illustrates a single joint of gravel-pack screen, typically however, multiple joints of gravel-pack screen will be used as seen in FIGS. 3 and 4.

In a gravel-packed vertical well, vertical flow can occur in the following three places inside casing 14: (1) in the gravel (i.e., flow path 36); (2) inside the perforated tubing (i.e., flow path 37); and usually (3) between the inside of the spiral-wrapped screen and the outside of the perforated tubing along side of the vertical ribs (i.e., flow path 38); however, some gravel-pack screen designs eliminate flow path 38. The vertical flow path 38 between the inside of spiral-wrapped screen 24 and the outside of perforated tubing 20 is blocked at each end 34 of each joint of screen 24 (FIG. 3 and 4). In order to reduce or eliminate water production from water-producing interval 13, first it is necessary to block off the portion of perforated tubing 20 below water level 32. The mechanical features of a gravel-packed well make it difficult to selectively block off specific intervals (e.g., water-producing intervals) without damaging the flow capacity of desirable fluid-producing intervals. Preferably, all the work necessary to block off the specific interval is performed with tools that fit through production tubing 18 (i.e., "through-tubing" tools), so that removal of production tubing 18 is not necessary to achieve shut off of the undesirable fluids. The methods of the present invention utilize just such through-tubing tools and techniques.

Figure 2:
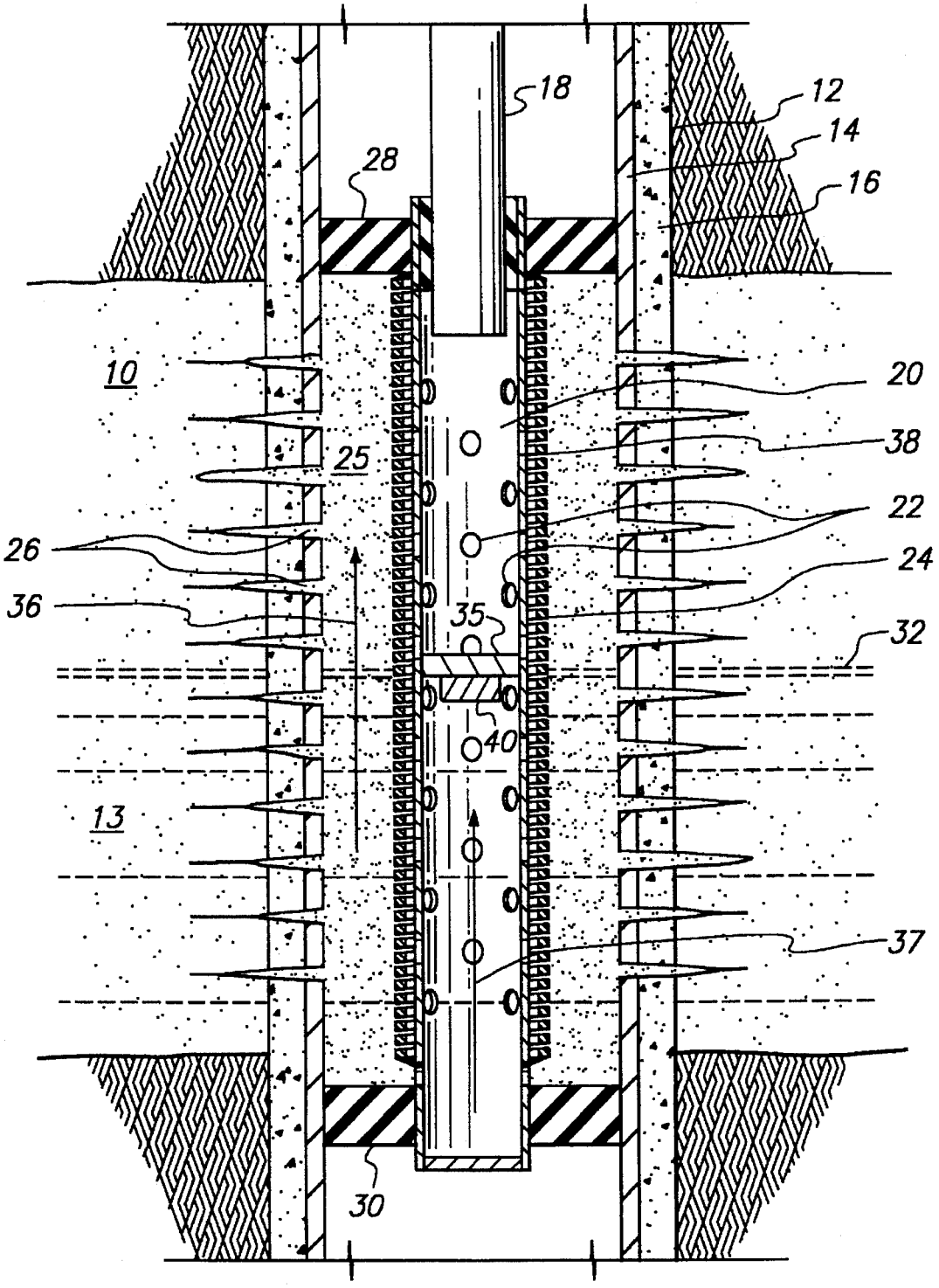
FIG. 2 is a cross-section as in FIG. 1 with a plug positioned to release a plugging material to form a barrier to the encroachment of the water.

Referring to FIG. 2, in accordance with one embodiment of the present invention a through-tubing plug 35 is placed in perforated tubing 20 and set across the inside of the perforated tubing near water level 32. As will be appreciated by one of ordinary skill in the art, plug 35 can be a custom designed plug to meet the conditions of a given well, or can be any of a number of available through-tubing plugs. For example, the bridge plug disclosed in the article by Mendez et at. entitled "Field Use of Thru-Tubing Electric Wireline Set Bridge Plug System", OTC 6459, presented at the 22nd Annual Offshore Technology Conference in Houston, Tex., May 7–10, 1990 or the bridge plug disclosed in U.S. Pat. No. 3,314,479 issued on Apr. 18, 1967 to McCullough et al. Plug 35 can be set with any method used to install through-tubing plugs, for example, regular tubing (i.e., jointed pipe), coiled tubing, wireline, slick line, etc. Placement of plug 35 in the perforated tubing is effective in eliminating water flow along flow path 37 inside of perforated tubing 20. However, water is still free to travel along flow paths 36 and 38.

In U.S. Pat. No. 5,090,478 issued Feb. 25, 1992 to Summers it was disclosed to place two layers of sand on a plug in the perforated tubing and release a settable liquid resin through the perforated tubing onto the top of the sand whereby the resin flows outward to form a layer of resin extending from the tubing into the gravel to form a barrier to the flow of water along flow paths 36 and 38. However, it is believed that fluid flow along flow paths 36 and 38 stops or inhibits the liquid resin from reducing the gravel's flow capacity in many situations, particularly in gravel with high flow capacity or when the interval producing the undesirable fluid has a higher pressure. Likewise, fluid can flow around the plug either inside or outside the wellbore (i.e., through the gravel pack or the formation). This downhole fluid movement is often referred to as "crossflow."

In accordance with the present invention, a plugging material is released below plug 35. In one embodiment, the plugging material is released from carrier (i.e., releasing tool) 40. By releasing the plugging material below plug 35 in the perforated tubing 20, the fluid flow (e.g., crossflow) in the well carries the plugging material into the location where it is needed and in proportion to the amount that is needed to form a barrier against the encroachment of water along flow paths 36 and 38. The releasing method used for the release of the plugging material can be accomplished in any of a variety of ways, some of which will be described herein as examples. Carrier 40 does not have to be attached to plug 35. In addition, carrier 40 can be as long as necessary to provide the plugging material. The releasing method below plug 35 can be a time-controlled release, an environmentally-controlled release, or a simultaneous release in conjunction with the setting of plug 35. The simultaneous release can be electrically, chemically, or mechanically coupled to the plug setting mechanism.

Referring to FIG. 3, in accordance with one embodiment of the present invention a through-tubing plug 35 is placed in perforated tubing 20 and set across the inside of the perforated tubing in blank area 42 between two joints of screen 24. Placement of plug 35 in blank area 42 has found to be particularly effective in reducing or eliminating the flow of water because it takes advantage of two flow inhibitors. First, ends 34 of each joint of screen 24 are sealed off thus blocking flow along flow path 38. Second, the water must flow into gravel 25 to bypass plug 35. The flow capacity within the gravel is lower, therefore flowing vertically through the gravel is a restriction and reduces undesirable fluid-production. As will be recognized by one of ordinary skill in the art, "landing nipples" or "profile nipples" (i.e., receptacles) can be present for receiving the obstruction. The plugging material can be released from carrier 40 below plug 35 as discussed with reference to FIG. 2. By releasing the plugging material below plug 35 in the perforated tubing 20, the fluid flow (e.g., crossflow) in the well carries the plugging material into the location where it is needed and in proportion to the amount that is needed to form a barrier against the encroachment of water along flow path 36.

Figure 5:
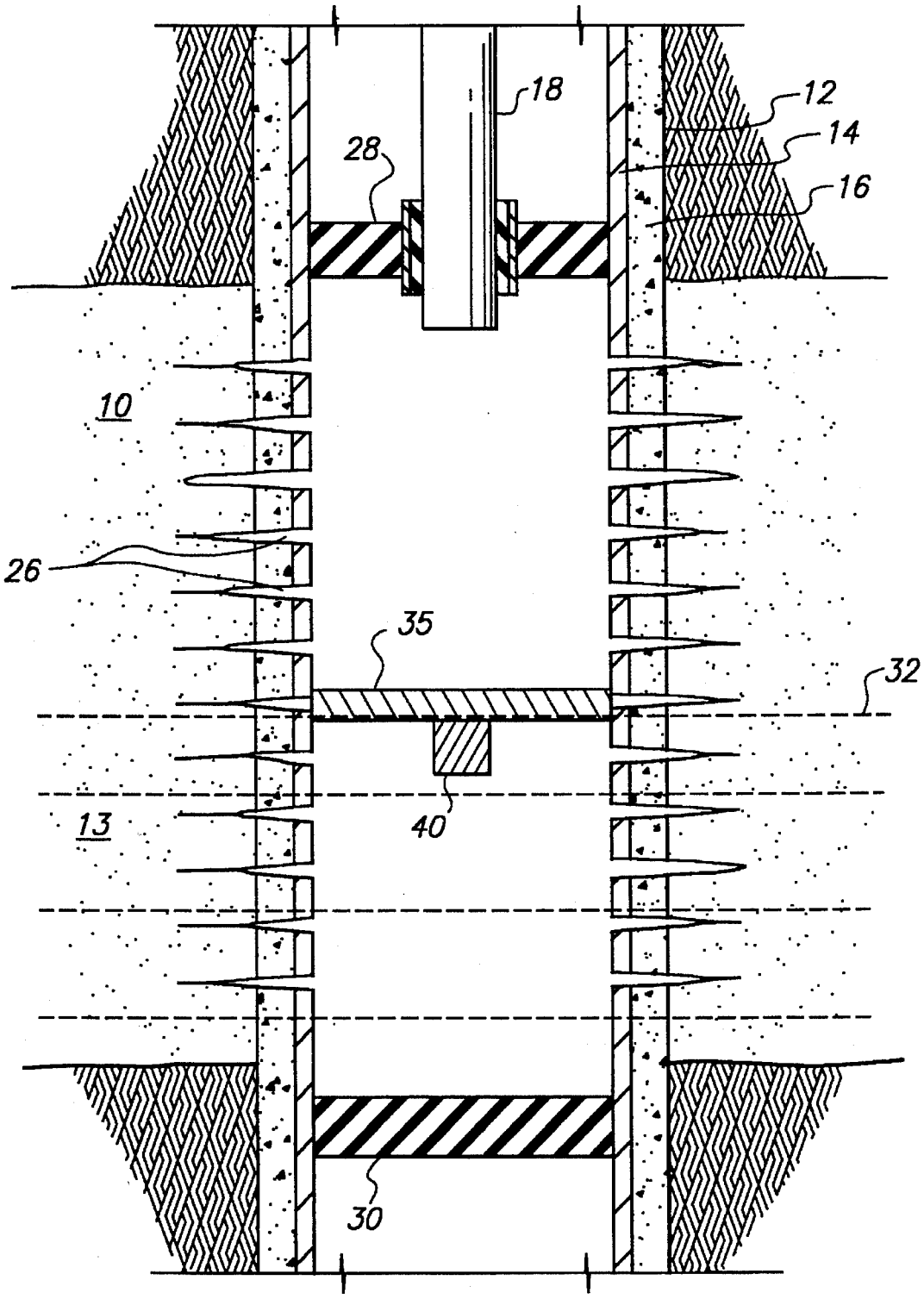
FIG. 5 is a cross-section of a cased and perforated completion with a plug and plugging material carrier positioned to form a barrier to the encroachment of water.

FIG. 5 illustrates that the present invention can also be used in a cased-hole completion or other well without a gravel pack assembly. Plug 35 is placed across the casing 15 near the base of the desirable fluid-producing interval 10. A plugging material is released below plug 35 from carrier 40 as discussed previously. The plugging material can be carried out through perforations 26 into the formation to form a barrier outside of casing 14. The plugging material can be selected to form a barrier to the flow of undesirable fluids between casing 14 and cement 16, between cement 16 and the formation, or both.

Releasing tool 40 is shown diagrammatically in FIGS. 2–5, but as will be recognized by one of ordinary skill in the art, there are several methods and/or tools, either existing or custom-designed, that can be used for carrying and releasing the plugging material depending on several implementation factors. The following list of implementation factors is illustrative, but not complete, of the factors that are to be considered: well type; completion type; desirable fluid type; undesirable fluid type; plugging material used; plug used; number of fluid-producing intervals to be shut-off; etc. It is within the skill of one of ordinary skill in the art to select the appropriate method and/or releasing tool based on the implementation factors.

In one embodiment, carrier 40 could be a positive displacement dump bailer. This is a mechanical device cylindrical in shape, which is filled with the plugging material and lowered into the well with or before plug 35. The bailer is positioned at the desired depth and when activated, releases a metal bar in the top of the device. The bar falls downward inside the device and impacts the top of the plugging material creating a downward moving shock wave which travels through the plugging material contained by the bailer. The shock wave causes the shearing of metal pins in the bottom of the bailer and subsequent downward movement of a small piston which uncovers ports to allow the release of the plugging material. The metal bar continues to fall through the bailer as plugging material is released through the ports. The weight of the metal bar effectively adds to the weight of the plugging material being dumped. As the bar falls to the bottom of the bailer, the cylindrical bailer tube is wiped clean of the plugging material.

Other types of positive displacement dump bailers, which operate in a similar manner, may also be used. It is also possible to deliver the plugging material in an open bailer. This is a bailer which is open at the top and closed at the bottom. When activated, the bottom cover, which is held by metal pins, is sheared by an explosive or by other means thereby opening the bottom and allowing the plugging material to flow by gravity from the bottom of the bailer and into the formation. In another embodiment, a pressurized chamber can be used that expels the plugging material when the pressure is released (e.g., a carbon dioxide cylinder).

A coiled tubing (not shown) may also be used to place the plug and the plugging mixture at the desired point in the well. Coiled tubing is especially valuable for using the methods in highly-inclined or horizontal wells. The coiled tubing is a pipe which is wound on a spool at the surface of the well. Coiled tubing can be installed or removed by equipment which is smaller, lighter, and more portable than equipment required for removal of production tubing 18. The coiled tubing sometimes contains a shielded electrical conductor ("wireline"), which can be used to control operation of tools attached to the end of the coiled tubing. Alternatively, tools attached to the end of the coiled tubing can be controlled with tension or compression applied through friction with the production tubing 18, hydraulic pressure, time delay, or a combination of the above. The outer diameter of the coiled tubing is less than the inner diameter of the production tubing 18, allowing the coiled tubing to be uncoiled and lowered into the well while the production tubing is still in place. The plugging material carrier and the plug 35 can be conveyed into the well separately using the coiled tubing. In another alternative, the plugging material and the plug 35 can be conveyed into the well simultaneously using the coiled tubing. In still another alternative, the plugging material without a carrier can be pumped through the coiled tubing after the plug has been installed. In yet another alternative, plugging material in a carrier can be pumped through the coiled tubing after the plug has been installed.

Other novel methods and tools can be used to deliver and release the plugging material below the plug. A desirable quality of carrier 40 is that it is retrievable or "disappears" after it has released the plugging material. As a result, the carrier outer diameter should be equal to or smaller than the diameter of the plug. Likewise, it must remain or return to that size after release of the plugging material. In the alternative, in one embodiment the carrier can be released from the plug and left in the bottom of perforated tubing 20. The carrier can be a frangible carrier that shatters when explosively setting the plug or fragments in response to a time-controlled explosion. Thus it will be appreciated that the plugging material can be released simultaneously with the setting of plug 25 or subsequent to the setting of plug 25. The fragments from a frangible carrier can serve as plugging material and even be designed to achieve plugging. The time-controlled release has several advantages such as it can be simply customized using time adjustment and that it is fully retrievable before release of the plugging material, if desired. In some circumstances, it is desirable to place and release the plugging material in the perforated tubing before setting plug 25 in the tubing.

In another embodiment of the present invention, a dissolvable carrier can be used. The material used to form the carrier is selected to dissolve in response to downhole well conditions of either temperature, pressure, or well fluid composition or a combination of these conditions. Likewise, the carrier can be a melting or subliming carrier that goes through a phase change in response to the downhole well conditions. A chemically-controlled release method can be used in which a carrier can be made from a composition that has an internal chemical breaker mechanism that dissolves the carrier or causes it to go through a phase change as a chemical reaction progresses over time. Temperature-controlled, chemically-controlled and fluid composition-controlled release methods are mechanically simple and are typically less costly than explosive release methods.

With whatever method and/or tool used, the plugging material (not shown) is released below plug 35 and flows into perforated tubing 20. The plugging material is not shown released in FIGS. 2–5 because it can be many different materials that form different barriers in different locations depending on the downhole conditions, the type of material used, the amount of material used, etc. For example, the plugging material can be selected to reduce the flow capacity just along flow path 38 alone or along flow path 36 as well. In other words, a barrier can be formed in the screen interface, a barrier can be formed in the gravel to reduce the flow capacity of the gravel adjacent to the plug, or a barrier can be formed in both. In some circumstances, the plugging material may flow from perforated tubing 20 through gravel pack 25 and into the intervals 10 and 13 to form a barrier to the flow of undesirable fluid in the producing zones.

As will be appreciated by one of ordinary skill in the art, a variety of plugging materials can be used in accordance with the present invention. In one embodiment an inert, particulate material is used. The particulate material is sized to form an internal filter cake in the gravel. The sizing of the particulate material is determined by applying Saucier's Rule. Saucier's Rule says that if the plugging material particles are smaller than 1/7 of the size of the gravel particles then the plugging material will be carried all the way up through the gravel by the fluid flow without stopping and forming particle bridges inside the gravel 25. If the plugging material particles are larger than 1/3 of the size of the gravel particles then the plugging material will not penetrate into the gravel 25. Therefore, the plugging material particles must be sized between these limits so that they will travel through the screen out into the gravel where they form an internal filter cake by plugging the pores between the gravel particles. Some particulate materials that may be used in accordance with the present invention are disclosed in U.S. Pat. No. 4,444,264 issued Apr. 24, 1984 to Dill, U.S. Pat. No. 5,222,558 issued Jun. 29, 1993 to Montgomery et al., and U.S. Pat. No. 5,228,524 issued Jul. 20, 1993 to Johnson et at. This list is only illustrative (and not complete) of the types of materials that may be used in accordance with the present invention. The inert material is particularly useful because it can be removed more easily from the wellbore if the method needs to be reversed or reworked for particular reasons. Another material that can be used in accordance with the present invention is a chemically stabilized emulsion with internal-phase droplets sized to plug the pores between the gravel particles.

In another embodiment, the plugging material can be a chemically-reactive material that flows out from the perforated tubing 20 and then forms a barrier to the flow of undesirable fluids by reacting in response to downhole well conditions of either temperature, pressure, or well fluid composition or a combination of these conditions. With this type of plugging material, reaction-initiation timing is important. Using inert particulate material instead of a chemically-reactive material can be beneficial because it does not require the timing of a chemical reaction (e.g., hardening). However, an advantage of chemically-reactive materials is that they may achieve better shut-off of undesirable fluid flow. One example of this type of material is disclosed in U.S. Pat. No. 4,972,906 issued Nov. 27, 1990 to McDaniel. In McDaniel, a mixture of a liquid epoxy material and a hardener is used that has an activation temperature lower than the downhole formation temperature. The epoxy material in McDaniel goes through several physical stages after being placed on top of the plug. In the first stage, it is a flowable liquid of relatively low viscosity, particularly at higher temperatures. When the temperature of the epoxy material reaches the activation temperature of the hardener, it begins to react and increase in viscosity. Eventually the epoxy material hardens sufficiently that it ceases to flow. With additional time, the epoxy material continues to react and harden until it becomes a solid. Another example of this type of material is disclosed in U.S. Pat. No. 5,090,478 issued Feb. 25, 1992 to Summers. The material in Summers is a settable liquid resin such as an epoxy resin formulated to set in a reasonably short time at formation conditions. Again these materials are only illustrative, and as will be appreciated by one of ordinary skill in the art many other materials such as phenolic resins, furan resins, etc. can be used in accordance with the present invention. If it is desired to reverse or rework the wellbore, the epoxy-type materials can be drilled out of the well or be removed by other known techniques.

The plugging material can have different characteristics depending on the conditions. In one embodiment, the plugging material used is buoyant. The buoyant plugging material floats at the highest level of the water until it is positioned in the gravel where it is needed by the flow (e.g., the crossflow) of the fluid. In other words, a plugging material having a lower density than the well fluids will remain near the bottom of plug 35 after it is released until fluid flow in the well carries the plugging material into gravel 25. The following materials are buoyant or could easily be made buoyant for use in accordance with the present invention: porous glass beads; porous ceramic beads; fibrous materials; cellulose; glass; natural polymers (e.g., xanthan, guar, etc.); synthetic polymers (e.g., hydroxyethylcellulose, hydroxypropyl guar, polyacrylamide, etc.); pumice; diatoms; stable microemulsion slurries of polymers or bentonite; paper; etc. These materials can also be coated with another composition designed to impart some desired property such as thermal stability, mechanical strength, insolubility, etc. This list is only illustrative (and not complete) of the types of materials that may be used in accordance with the present invention.

An example of one embodiment of the present invention is to place a dissolvable carrier such as a wax tube filled with porous glass spheres in the well. Then set an obstruction in the well above the wax tube. The wax tube has a melting temperature a few degrees below the downhole temperature of the well so that the porous glass spheres will be released into the well after the wax tube has dissolved.

In another embodiment, the plugging material can be non-buoyant or a combination of buoyant and non-buoyant material. A mixture of buoyant and non-buoyant material is particularly useful for horizontal wells and multiple zone applications such as shown in FIG. 4. FIG. 4 illustrates the use of multiple plugs in a wellbore having multiple producing intervals. Intervals 10 and 11 are desirable fluid-producing intervals. Intervals 48 and 50 are impermeable layers (e.g., shale) between the producing intervals. Interval 13 was previously a desirable fluid-producing interval but due to the encroachment of water it is now producing undesirable fluids. In order to allow for the continuous production of desirable fluids from intervals 10 and 11, plug 35 is set in perforated tubing 20 above water level 32 and plug 44 is set in perforated tubing 20 near the base of the water-producing interval 13. A device, such as bypass tube 46, can be used to continue to allow the flow of desirable fluids from interval 11. The device or method used to allow desirable fluids to still be produced from interval 11 can be any of a number of tools and methods and is certainly not restricted to bypass tube 46.

As discussed with reference to FIG. 3, the placement of plugs 35 and 44 between the joints of screen 24 is effective in reducing or eliminating the flow along flow paths 36 and 37. To further reduce or eliminate the flow along flow path 36 and to prevent flow from interval 13 into screen 24 corresponding to interval 11, a mixture of buoyant and non-buoyant material (not shown) can be released from carrier 40. The buoyant material will act as previously discussed. The non-buoyant material (i.e., material that is more dense than the wellbore fluid) will travel down and out through perforated tubing 20 adjacent to plug 44 to form a barrier to the flow of undesirable fluid from interval 13 into interval 11. In another embodiment, carrier 40 can release the buoyant material and a second carrier (not shown) spaced from carrier 40 can release the non-buoyant material. In other embodiments, carrier 40 may be spaced from plug 35 and 44. Carrier 40 in FIG. 4 is an annular device surrounding bypass tube 46. As mentioned above, carrier 40 is shown only diagrammatically such that the plugging material can be released by any of a number of tools and/or methods.

An unlimited number of plugs can be installed in the same wellbore to selectively shut-off undesirable fluid production from intermediate zones in the well. The tandem or multiple plug embodiments are useful in many applications, for example, reducing or eliminating gas production from above an oil producing interval and water production from below an oil producing interval; reducing or eliminating gas production from above and below an oil producing interval; reducing or eliminating water production from above and below an oil producing interval; etc.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method for reducing the production of undesirable fluid from a well having a production zone, the production zone including an undesirable fluid-producing interval and a desirable fluid-producing interval, said method comprising:

placing an obstruction in the production zone near a base of the desirable fluid-producing interval; and releasing a plugging material below said obstruction without pumping said plugging material from the surface of the well, whereby said plugging material forms a barrier to the flow of undesirable fluid from the undesirable fluid-producing interval into said desirable fluid-producing interval while producing from said desirable fluid-producing interval.

2. The method of claim 1 wherein said plugging material is buoyant whereby said plugging material is carried where needed by the flow of undesirable fluid in the production zone.

3. The method of claim 1 wherein said plugging material is a combination of buoyant material which is carried where needed by the flow of undesirable fluid in the production zone and non-buoyant material which moves to the bottom of the production zone.

4. The method of claim 1 wherein said plugging material is non-buoyant whereby said plugging material moves to the bottom of the production zone.

5. The method of claim 1 wherein the well has a gravel-containing region traversing the production zone, the gravel-containing region having a perforated tubing surrounded by a screen, the screen being surrounded by gravel, said method further comprising: placing said obstruction in the perforated tubing, whereby when said plugging material is released said plugging material forms a barrier to the flow of undesirable fluid.

6. The method of claim 5 wherein said obstruction is placed in the perforated tubing at a position corresponding to the end of a joint of perforated tubing.

7. The method of claim 5 further comprising:

placing a second obstruction in the perforated tubing spaced from said obstruction, whereby said plugging material forms a barrier to the flow of undesirable fluid between said obstruction and said second obstruction.

8. The method of claim 7 wherein said plugging material is buoyant whereby said plugging material is carried where needed by the flow of undesirable fluid in the production zone.

9. The method of claim 7 wherein said plugging material is non-buoyant whereby said plugging material moves to the bottom of the production zone.

10. The method of claim 7 wherein said plugging material is a combination of buoyant material which is carried where needed by the flow of undesirable fluid in the production zone to form a barrier to the flow of undesirable fluid and non-buoyant material which forms a barrier adjacent to said second obstruction.

11. The method of claim 7 wherein said obstruction and said second obstruction are in fluid communication such that desirable fluid flows from below said second obstruction to above said obstruction.

12. The method of claim 1 wherein said plugging material forms the barrier to the flow of undesirable fluid behind a casing lining the production zone.

13. The method of claim 1 further comprising:

placing a second obstruction spaced apart from said obstruction, whereby said plugging material forms a barrier to the flow of undesirable fluid between said obstruction and said second obstruction.

14. The method of claim 13 wherein said plugging material is buoyant whereby said plugging material is carried where needed by the flow of undesirable fluid in the production zone.

15. The method of claim 13 wherein said plugging material is non-buoyant whereby said plugging material moves to the bottom of the production zone.

16. The method of claim 13 wherein said plugging material is a combination of buoyant material which is carried where needed by the flow of undesirable fluid in the production zone to form a barrier to the flow of undesirable fluid and non-buoyant material which forms a barrier near said second obstruction.

17. The method of claim 13 wherein said obstruction and said second obstruction are in fluid communication such that desirable fluid flows from below said second obstruction to above said obstruction.

18. The method of claim 1 wherein said plugging material is an inert material.

19. The method of claim 1 wherein said releasing step is a time controlled release.

20. The method of claim 1 wherein said placing of the obstruction and releasing of the plugging material occurs simultaneously.

21. The method of claim 1 wherein said obstruction is placed with regular tubing, coiled tubing, an electric wireline, or a slick line.

22. The method of claim 1 wherein said plugging material is released from a plugging material carrier attached to said obstruction.

23. The method of claim 1 further comprising:

installing a plugging material carrier in the production zone before said obstruction.

24. The method of claim 1 wherein said plugging material is released before placing said obstruction.

25. The method of claim 1 wherein said plugging material is a chemically-reactive material.

26. The method of claim 1 wherein said releasing step is an environmentally controlled release.

27. A method for reducing the production of undesirable fluid from a well having a production zone, the production zone including an undesirable fluid-producing interval and a desirable fluid-producing interval, said method comprising:

placing an obstruction in the production zone near a base of the desirable fluid-producing interval; and releasing a buoyant plugging material below said obstruction, whereby said buoyant plugging material forms a barrier to the flow of undesirable fluid from the undesirable fluid-producing interval into said desirable fluid-producing interval while producing from said desirable fluid-producing interval.

28. The method of claim 27 wherein said buoyant plugging material further comprises non-buoyant material which moves to the bottom of the production zone.

29. The method of claim 27 wherein the well has a gravel-containing region traversing the production zone, the gravel-containing region having a perforated tubing surrounded by a screen, the screen being surrounded by gravel, said method further comprising:

placing said obstruction in the perforated tubing, whereby when said buoyant plugging material is released said buoyant plugging material forms a barrier to the flow of undesirable fluid.

30. The method of claim 29 wherein said obstruction is placed in the perforated tubing at a position corresponding to the end of a joint of perforated tubing.

31. The method of claim 29 further comprising:

placing a second obstruction in the perforated tubing spaced from said obstruction, whereby said buoyant plugging material forms a barrier to the flow of undesirable fluid into said perforated tubing between said obstruction and said second obstruction.

32. The method of claim 31 wherein said buoyant plugging material further comprises non-buoyant material which forms a barrier adjacent to said second obstruction.

33. The method of claim 31 wherein said obstruction and said second obstruction are in fluid communication such that desirable fluid flows from below said second obstruction to above said obstruction.

34. The method of claim 27 wherein said buoyant plugging material forms the barrier to the flow of undesirable fluid behind a casing lining the production zone.

35. The method of claim 27 further comprising:

placing a second obstruction spaced apart from said obstruction, whereby said buoyant plugging material forms a barrier to the flow of undesirable fluid between said obstruction and said second obstruction.

36. The method of claim 31 wherein said buoyant plugging material further comprises non-buoyant material which forms a barrier near said second obstruction.

37. The method of claim 31 wherein said obstruction and said second obstruction are in fluid communication such that desirable fluid flows from below said second obstruction to above said obstruction.

38. The method of claim 27 wherein said buoyant plugging material is an inert material or a chemically-reactive material.

39. The method of claim 27 wherein said releasing step is a time controlled release.

40. The method of claim 27 wherein said placing of the obstruction and releasing of the buoyant plugging material occurs simultaneously.

41. The method of claim 27 wherein said obstruction is placed with regular tubing, coiled tubing, an electric wireline, or a slick line.

42. The method of claim 27 wherein said buoyant plugging material is released from a plugging material carrier attached to said obstruction.

43. The method of claim 27 further comprising:

installing a plugging material carrier in the production zone before said obstruction.

44. The method of claim 27 wherein said buoyant plugging material is released before placing said obstruction.

45. A method for reducing the production of undesirable fluid from a well having a gravel-containing zone traversing a production zone having a perforated tubing surrounded by a first screen separated from a second screen by a blank area, and a third screen separated from the second screen by a blank area, the production zone having gravel around the first screen, the second screen, and the third screen, the production zone including an undesirable fluid-producing interval and at least one desirable fluid-producing interval, said method comprising:

placing a first obstruction in the perforated tubing at a location corresponding to the blank area between the first screen and the second screen; and placing a second obstruction in the perforated tubing at a location corresponding to the blank area between the second screen and the third screen, said second obstruction being in fluid communication with said first obstruction.

46. The method of claim 43 further comprising:

releasing a plugging material below said obstruction, whereby said plugging material forms a barrier to the flow of undesirable fluid from the undesirable fluid-producing interval into the desirable fluid-producing interval.

47. The method of claim 45 wherein said plugging material is buoyant whereby said plugging material is carried where needed by the flow of undesirable fluid in the production zone.

48. The method of claim 45 wherein said plugging material is non-buoyant whereby said plugging material moves to the bottom of the production zone.

49. The method of claim 45 wherein said plugging material is a combination of buoyant material which moves into the production zone to form a barrier to the flow of undesirable fluid and non-buoyant material which forms a barrier near said second obstruction.

50. The method of claim 27 wherein said buoyant plugging material is a chemically-reactive material.

51. The method of claim 27 wherein said releasing step is an environmentally controlled release.

* * * * *